United States Patent [19]

Garthoffner

[11] Patent Number: 4,615,391

[45] Date of Patent: Oct. 7, 1986

[54] IN-SITU COMBUSTION IN HYDROCARBON-BEARING FORMATIONS

[75] Inventor: Egon H. Garthoffner, Bakersfield, Calif.

[73] Assignee: Tenneco Oil Company, Bakersfield, Calif.

[21] Appl. No.: 640,384

[22] Filed: Aug. 13, 1984

[51] Int. Cl.[4] ..... E21B 43/24; E21B 43/243

[52] U.S. Cl. ..... 166/257; 166/261; 166/262; 166/270; 166/300

[58] Field of Search ..... 166/257, 260, 261, 262, 166/270, 300, 302

[56] References Cited

U.S. PATENT DOCUMENTS 2,818,118 12/1957 Dixon .
2,975,834 3/1961 West et al. ..... 166/300
3,010,513 11/1961 Gerner .
3,127,935 4/1964 Poettmann et al. .
3,205,947 9/1965 Parker .
3,314,476 4/1967 Staples ..... 166/300
3,400,763 9/1968 Klein et al. .

FOREIGN PATENT DOCUMENTS 787621 12/1980 U.S.S.R. ..... 166/300

*Primary Examiner*—George A. Suchfield
*Attorney, Agent, or Firm*—Donald D. Mon

[57] ABSTRACT

Finely divided, preferably colloidally sized magnesium metal particles in an aqueous suspension are infused throughout a hydrocarbon-bearing formation and combusted or reacted with water for in-situ combustion to heat the formation.

8 Claims, 1 Drawing Figure

IN-SITU COMBUSTION IN HYDROCARBON-BEARING FORMATIONS

FIELD OF THE INVENTION

This invention relates to in-situ reaction with water of metallic magnesium in an oil-bearing strata to generate heat and gases in the strata for stimulating production of wells in formations containing heavier oils or tars.

BACKGROUND OF THE INVENTION

It is conventional practice to heat formations containing heavy oil or tars to stimulate the extraction. The objective is suitably to lower the viscosity of the oils and tars so they can flow through the formation and the well.

Steam injection is widely used for this purpose. Its applicability is not universal, however. There are many constraints which render steam injection either unsuccessful or only marginally successful. One is that the maximum temperature rise attainable with steam injection may not be sufficient to reduce the viscosity of very heavy oils and tars enough to enable them to move at acceptable rates. Another is the tendency of steam (or heated air when used) to override the oil—that is, rise to the top of it. Heat transfer to the oil is much less effective when the steam is on top than if the heat is applied within or below the oil or tar.

Some of the shortcomings of steam injection can be overcome by a different class of process, in which combustion is conducted within the formation itself—in-situ combustion (ISC). Higher temperature combustion processes can be employed with these processes. In some of these processes, the fuel for combustion is injected into the formation and combusted in-sutu. In others, the formation itself is ignited and part of it is combusted. In this latter procedure, part of the oil or tar is sacrificed to generate the heat. Poettmann, U.S. Pat. No. 3,127,935 provides examples of both of these techniques. This invention constitutes an improved in-situ combustion process.

A considerable disadvantage of steam injection, and also of injection of air and air-fuel mixtures into a formation is the cost of necessary fixed installations such as boilers, pipelines, and compressors, and costs of energy to operate them. A further disadvantage of these systems is that they frequently consume, on an energy balance basis, about one barrel of oil for each two barrels of oil produced, and generally derive this energy from fossil fuels.

It is an object of this invention to heat a formation by ISC which does not require air to be injected to maintain the reaction, nor combustion of the resource to be extracted, nor the supply of any gaseous fuel.

It is another object of this invention to provide an ISC process in which gases that are generated by it can improve both the physical and chemical properties of the oils extracted from the well.

BRIEF DESCRIPTION OF THE INVENTION

This invention comprehends the injection of metallic magnesium directly into the oil or tar strata, where it is combusted or reacted with water. Magnesium hydroxide and hydrogen gas are produced. This is a strongly exothermal reaction, capable of producing large local increases in temperature. This is accomplished with the injection of surprisingly small quantities of magnesium, and can substantially and usefully raise the temperature of the strata.

The magnesium is conveniently and preferably injected as an aqueous colloidal suspension, and will tend to deposit on the solid particles in the formation. "Injection" by this process differs significantly from known ISC processes. For example fuels—even solid fuels such as magnesium, are previously shown to be packed into fractures in the formation to be heated. Such a technique is shown in Dixon, U.S. Pat. No. 2,818,118 and Gerner U.S. Pat. No. 3,010,513. However, the heat generated in the fractured zone must thereafter be conducted throughout the formation, a slow and inefficient process. In the practice of the instant invention, the fuel is injected in the sense of infusion, and flows throughout the formation, within the cells which contain oil and water so as to be in intimate heat transfer relationship with rock, and with the water and oil or tar throughout the formation. The magnesium may be ignited by any suitable method. Most conveniently, air can be supplied to assist or cause ignition. At well temperatures and pressures, it will ignite the oil or tar, which in turn will start the reaction of the magnesium and water. Continuing reaction will not require the supply of any gas from an external source. Water in the suspension will be adequate as an oxygen donor for the process. Also, water already in the formation may be available for this purpose. There will usually be more than enough water for this purpose.

The hydrogen generated by this combustion is potentially useful for several purposes: reduction of viscosity of the oil and tar, increase in formation pressure, and hydrogenation of the oils and tars.

The above and other features of this invention will be fully appreciated from the following detailed description and the accompanying drawings, in which:

DETAILED DESCRIPTION OF THE INVENTION

Figure 1:
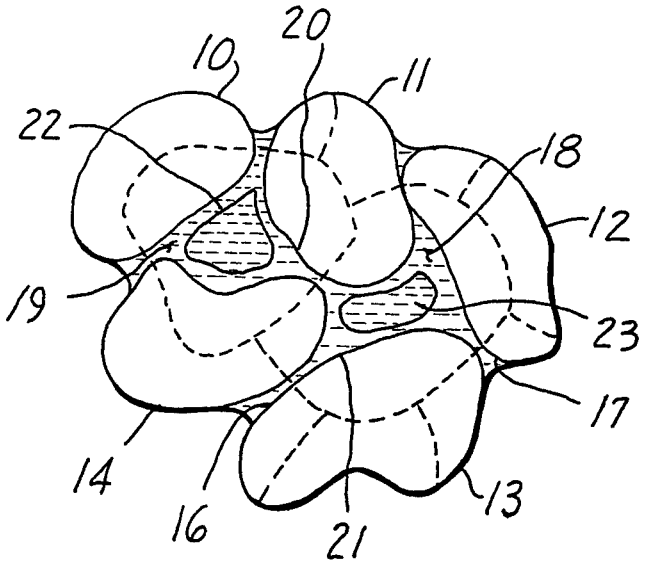
FIG. 1 is a schematic view of an oil or tar-containing cell in which this invention is to be accomplished.

This invention comprehends the reaction with water of metallic magnesium in-situ. This invention is expected most advantageously to be used in water-wet reservoirs, especially in sandstone reservoir rocks. A schematic showing of a typical formation is given in FIG. 1. Rock (sand) grains 10–15 are shown in a loosely compacted state. Pore throats, of which throats 16 and 17 are typical, are formed by the grains. Within the grains cells are formed, of which cells 18 and 19 are typical. Throats interconnect the cells to form a permeable structure. The grains are wettable by water, and water 20, 21 is shown in cells 18 and 19. Typically it wets the rock and extends as a capillary or meniscus through the throats. Inside the cells and surrounded by the water is the oil or tar, typical deposits being shown at 22, 23. The pore throats tend to be quite small in these formations, and it is evident that the viscosity of the oil or tar is a principal determinant of the flowability of the oil or tar. Reduction of viscosity greatly improves the situation, which is a reason for steam and hot water injection.

Sandstone rock formations most suitable for this process have: a high permeability, on the order of between about 1,000 and 4,000 md; water-wetting characteristics, a porosity between about 25% and about 35%, oil saturation of about 50% or greater; and water saturation between about 25% and about 50%.

The oils and tars sought to be recovered with the use of this process range generally from tars (less than about 10 degrees API) to low intermediate oil (about 20 degrees API).

The aqueous suspension of magnesium particles will be injected under pressure from the well into the surrounding formation. It displaces water ahead of it, and tends to coat the rock particles and the surface of the oil. The displacement of water in this type of formation is commonly accomplished in water flooding. The additional liquid added is generally acceptable because of the compressibility of the fluids, and of the presence of gases in the fluids or formation. While not all of the magnesium will necessarily deposit on the sand grains and oil, much of it will, because of the adsorptive properties of the grains and oils. Deposition is not an essential feature of this invention.

As a consequence of this invention, which is in the nature of an infusion throughout the formation or strata, and of the properties of the suspension, it becomes localized in the cells, either on the particles, or still in suspension, or both, so that when it is combusted, it is well-positioned in intimate immediacy with what it is to heat—the oil and the rock particles, as well as what water it does not consume.

In order to determine the colloidal particle size and total quantity of magnesium to be supplied, some useful assumptions and calculations can be employed.

When a solid is divided into progressively smaller particles, the total surface area increases geometrically. Division of a cube into smaller cubes is a useful approximation for purposes of this invention. A cube one centimeter on each edge has a surface area of only 6 square centimeters. Divided into particles of colloidal size (with range between about $10^{-5}$ to $10^{-6}$ edge dimension), the total surface area when divided into cubes having a 0.000005 cm edge dimensions is 1,200,000 square centimeters, an increase of 200,000 times.

Now, assuming a cubic piece of reservoir rock with a 1.0 centimeter edge dimension, with a porosity of about 30% and a permeability of about 2,000 md, it can be calculated with suitable approximations that there are about 656 square centimeters of surface. Colloidal particles with a total surface area of only about 4,000 square centimeters will coat this area. Stated most simply, only one cubic centimeter of the colloidally sized particles is needed to coat 300 cubic centimeters of rock of the above description.

Next an approximation is made to determine how much heat will be required to raise the rock and its contained fluids from a typical reservoir temperature (about 30 degrees C. to a useful operating temperature on the order of what steam can produce (about 150 degrees C.).

Useful assumptions are: porosity, 30%, oil saturation, 60%; and water saturation 40%. Density of matrix, 2.65; of oil at 10 degrees API, 1.0; and of water, 1.0. Specific heat of the matrix rock 0.22; of the oil 0.5; of the water, 1.0; and of steam 0.5. Weight of constituents per cubic centimeter are for the matrix 1.86 grams; for the oil 0.18 grams; and for the water 0.12 grams, a total of 2.16 grams. Heat of vaporization of water is 540 cal per gram of water.

Under best circumstances, when all heat of vaporization is returned to the formation, oil and water, 1 mole (gram molecular weight), 24.31 grams of magnesium will heat 2,893 cubic centimeters of rock to 150 degrees C. Under worst circumstances, where all of the heat of vaporization is lost, 1,869 cubic centimeters will be so heated. The actual result will be somewhere in between these numbers.

Stated more conveniently, in the best case, 1.0 c.c. of magnesium divided colloidally when reacted with water will suitably raise the temperature of about 208 c.c. of reservoir rock, and in the worst case, about 135 c.c. Most likely it will be about 170 c.c.

The above calculations show that somewhat more magnesium is needed than is required for merely coating the rock. But the extra amount involved is relatively small, and is easily provided. The excess over that which is needed to coat the rock aids in propagation of the reaction by improving the particle continuity. The temperature increase is approximately linear relative to the quantity of magnesium, so that temperature elevation can nicely be controlled by controlling the amount of magnesium supplied.

There is ample water in the formation or in the suspension to provide the necessary oxygen for the reaction. In fact there is at least several times the necessary amount. The colloidal size should be selected for its ease in passing through the pore throats. In the example given, the colloidal size is roughly one order of magnitude smaller than the throat size. Plugging of the formation with the magnesium is therefore highly unlikely.

The foregoing calculations show that injection of colloidal magnesium in surprisingly small quantities will readily heat a formation to temperatures associated with steam injection, and can heat them even hotter. The temperature at the reaction point is about 800 degrees C., but this temperature is not long maintained, and appreciable coking is not necessarily to be anticipated. Thus, the quality of product is not adversely affected. In fact, it may be improved. If a higher reservoir temperature is desired, this can be attained merely by increasing the amount of magnesium supplied.

The by-products of the reaction are magnesium hydroxide and hydrogen. The magnesium hydroxide will not plug the formation, and will exit with the oil or tar, from which it can readily be separated.

While the hydrogen can at least theoretically be recovered as such, there are more important potential benefits from it. One is its contribution to reservoir pressure. Another is a reduction in viscosity of the product as the consequence of the hydrogen's dissolving in the oil or tar. A third is hydrogenation. The first two benefits are evident from the description already given.

Hydrogenation, as the term is used here, is the cleavage by hydrogen at elevated temperatures and pressures, to increase the API gravity of the product (reducing its viscosity). Hydrogenation is used routinely to upgrade tars. The relatively high temperature and pressure at the combustion situs, in the presence of hydrogen, and especially in the presence of clay-containing sands, may be expected to result in at least some hydrogenated product.

There are very considerable advantages to the use of magnesium metal for the above purposes. It is a relatively plentiful inorganic fuel source. Its use eliminates the need for expensive scrubbers, and for much of the environmental controls required for processes that burn fossil fuels. It combusts quickly and does not require application of heat from other sources, such as is required with steam injection. Thus, production is accelerated, and reservoir heat losses are minimized.

This invention is not proposed as a replacement process for steam injection. There are many formations where steam injection is very acceptable. But there are also many formations where steam injection is not successful, or is only marginally successful. For example, tars tend to be 10 to 1,000 times more viscous than heavy oil crudes that are successfully stimulated by steam. The higher temperatures attainable from the reaction of magnesium and water can make extraction of these tars practicable.

As another example, in reservoirs composed of many thin sand members separated by thin shales and silts, especially when there is little dip in the sand beds, there is little vertical communication. With the instant process, the release of hydrogen gas and formation of steam in-situ will benefit production by raising the pressure.

As yet another example, very thick (200 feet or more) reservoirs with a high dip (greater than 45 degrees) are difficult for steam stimulation. This is because the steam quickly goes to the top of the sand. There is then less heat distribution and stimulation. The magnesium in this process can be placed low in the reservoir, and the heat will rise to the top, through the formation.

To ignite the magnesium, any suitable ignition means may be initiated at the well bottom. At first, it may be useful to supply air to assist the reaction to start. Once started, however, the heat generated at the reaction front will be sufficient to support propagation of the process. Of course the concentration of magnesium in the suspension must not be so low that this result is frustrated, but minor experimentation will establish that lower limit.

The process can be used cyclically in the sense that the magnesium is injected and reacted, and then the well is restored to production. This can be repeated as long as benefits result.

The process can instead be used continuously by injecting magnesium into a selected well and igniting it to stimulate production in surrounding wells. The injection of magnesium into the selected well is discontinued during the time the reaction takes place. The "continuous" terminology relates to the stimulated wells, which function without interruption to produce the oil.

These techniques can be used in combination with one another, and also with conventional processes. An example of the latter is to react the magnesium first, and then waterflood the heated area. Another is to use the magnesium reaction to preheat heavy oils or tars, and then inject air to pursue conventional ISC. This latter procedure can also be used in the continuous sense defined above.

This invention thereby provides a new and useful means to recover oils and tars by increasing their temperature, which is convenient to use, and is without many of the costs and objections of known processes.

This invention is not to be limited by the embodiments shown and described herein, which are given by way of example, and not of limitation, but only in accordance with the scope of the appended claims.

I claim:

1. The method of stimulating production in a formation bearing heavy oil or tar, comprising injecting into said formation colloidal particles of metallic magnesium and causing said magnesium to be ignited, thereafter to be exothermally reacted with water in-situ, whereby exothermally to produce magnesium hydroxide and hydrogen gas in said formation.

2. The method of claim 1 in which said magnesium particles are injected into said formation as part of an aqueous suspension.

3. The method of claim 2 in which said suspension is a colloidal suspension.

4. The method of claim 2 in which the quantity of said magnesium particles is selected to elevate a region in the well to a temperature conducive to the flow of the oil or tar.

5. The method of claim 4 in which the quantity of said magnesium particles is in excess of that needed to coat rock particles of the formation.

6. The method of claim 2 in which injection of the suspension is discontinued during the reaction, followed by extraction of oil or tar through the well used for injection.

7. The method of claim 2 in which the injection of the suspension is through one well and extraction of oil or tar is through a different well.

8. The method of claim 1 in which the size of the magnesium particles is no greater than about 1/10 the size of the throat pores in the formation into which they are injected.

* * * * *